United States Patent [19]

Yamashita et al.

[11] 4,252,044

[45] Feb. 24, 1981

[54] AUTOMATIC CUTTER POSITIONING DEVICE FOR A GANG SLITTER

[75] Inventors: Risaburo Yamashita; Toshiyuki Muramatu, both of Hamamatsu, Japan

[73] Assignee: Sumikura Industrial Company, Limited, Tokyo, Japan

[21] Appl. No.: 12,486

[22] Filed: Feb. 15, 1979

[30] Foreign Application Priority Data

Feb. 15, 1978 [JP] Japan ..... 53-16151

[51] Int. Cl.[3] ..... B26D 1/24; B26D 3/12; B26D 7/26

[52] U.S. Cl. ..... 83/499; 83/425.4; 83/503; 83/482

[58] Field of Search ..... 83/425.4, 499, 503, 83/500, 482, 560

[56] References Cited

U.S. PATENT DOCUMENTS

| | | | |
|---|---|---|---|
| 2,706,524 | 4/1955 | Hall | 83/503 X |
| 3,185,010 | 5/1965 | Printz et al. | 83/503 X |
| 3,540,340 | 11/1970 | Koskela | 83/499 |
| 3,685,379 | 8/1972 | Frye et al. | 83/499 X |
| 3,760,697 | 9/1973 | Besemann | 83/499 X |
| 4,116,098 | 9/1978 | Suzuki et al. | 83/499 X |

*Primary Examiner*—Donald R. Schran

*Attorney, Agent, or Firm*—Oblon, Fisher, Spivak, McClelland & Maier

[57] ABSTRACT

An automatic cutter positioning device in a gang slitter consisting of a frame assembly having an upper frame including rails, a lower frame including rails, and side frames. Cutter heads are slidably mounted to the upper and lower rails. Cutter shaft journalling cases are vertically slidably mounted on each cutter head. Spline shafts journalled by the side frames provide driving force to the cutter shafts through gears and belts. The cutter heads are moved so that the forward head moves faster then the rearward head.

1 Claim, 6 Drawing Figures

AUTOMATIC CUTTER POSITIONING DEVICE FOR A GANG SLITTER

BACKGROUND OF THE INVENTION

1. Field of the Invention

The present invention relates to an automatic cutter positioning device in the slitting portion of a slitter line for cutting of plates of steel, aluminum, copper, or their alloys into longitudinal strips.

2. Description of the Prior Art

As is well known, in the prior method of cutting, the distances between cutters in the slitter assembly of the conventional slitting line are first determined according to cutting factors of the work, such as width, plate thickness, materials, etc., then, to realize these distances, cutters and spacers of required dimensions are inserted in the shaft one after the other, and upper and lower cutter assemblies are thus formed. Whenever one or more of the factors is to be altered, the cutters and spacers must be disassembled and reassembled. Besides, due to the great number of combinations of cutting widths and number of strips to be cut, the required number of spacers increases more and more and much labor and expense are needed for their inventory control. It is foreseeable that when cutting factors such as the cutting width, strip number, etc., are different for each coil, it will become a problem that the reassembly of cutters and spacers will not be finished in time during the cutting of the preceeding coil as the coils are cut at higher speeds in the future. Also, it is desirable that preparatory stands which are conventionally used for interchange of cutters of a slitter be eliminated because of the problem of their factory management.

SUMMARY OF THE INVENTION

An object of the present invention is the improvement of the above situation. One feature of the invention is to assemble the cutter of each slitter into a head which moves laterally and vertically for the desired distances required for the positioning of the cutter and thus to perform slitting work. It is another object of the invention to provide a gang slitter which needs no replacing operation of the cutters.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
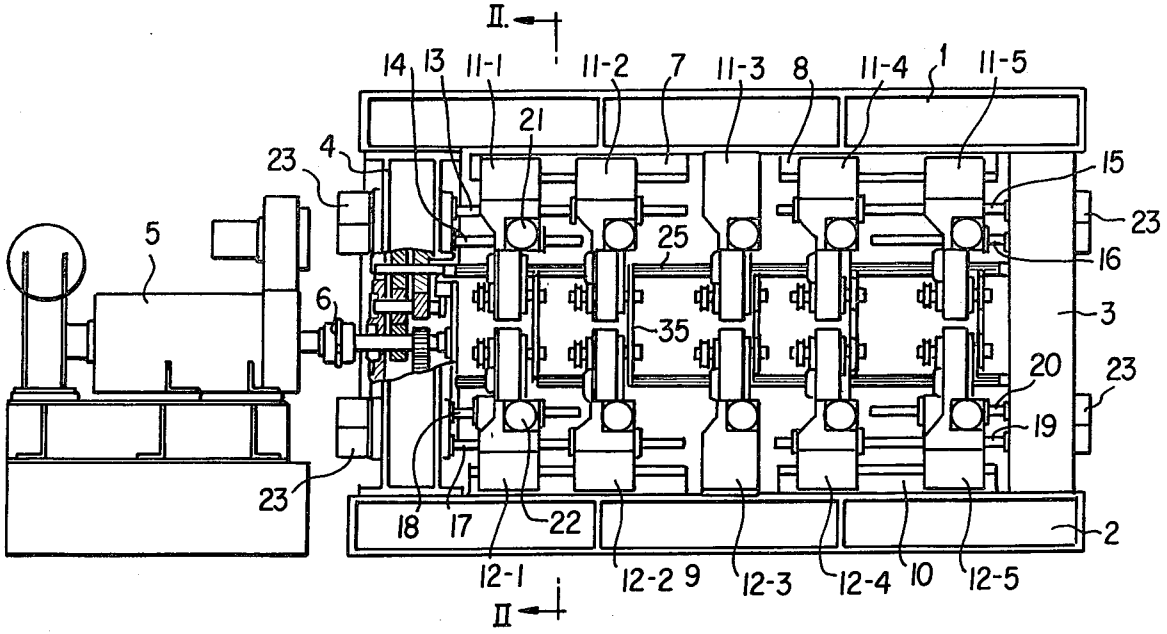
FIG. 1 is a front view of a slitter stand according to the invention.
Figure 2:
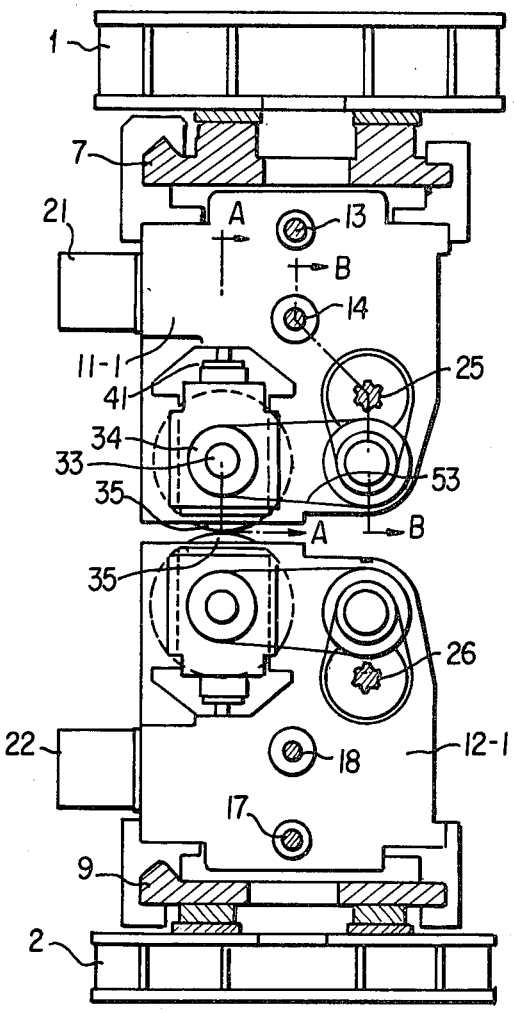
FIG. 2 is a sectional view taken along the line II—II of FIG. 1.

Referring now to the embodiment together with the attached drawings, a detailed description of the preferred invention will be given. FIG. 1 is a front view of a gang slitter according to the present invention. A frame assembly consisting of an upper frame 1, side frames 3 and 4, and a base 2, is provided with upper rails 7 and 8 and lower rails 9 and 10. Cutter heads 11-1 through 11-5 are slidably suspended from the rails 7 and 8 in the direction of the plate width (as shown in FIG. 2 which is a sectional view taken along the arrow line II—II in FIG. 1), and cutter heads 12-1 through 12-5 are likewise slidably mounted on the rails 9 and 10 in the direction of the plate width. The cutter heads can be located in the desired positions by rotation of ball screws 13 through 20 which are driven by motors 23 (pulse motors or those having a tacho-generator) fixed to the frame 3 or 4 respectively. Each head has one ball screw. The ball screw 13 which moves the head 11-2 is loosely fitted with adequate clearance to the head 11-1 so that the screw does not engage with the head 11-1. Likewise arrangement is made with the ball screws 15, 17 and 19.

Figure 3:
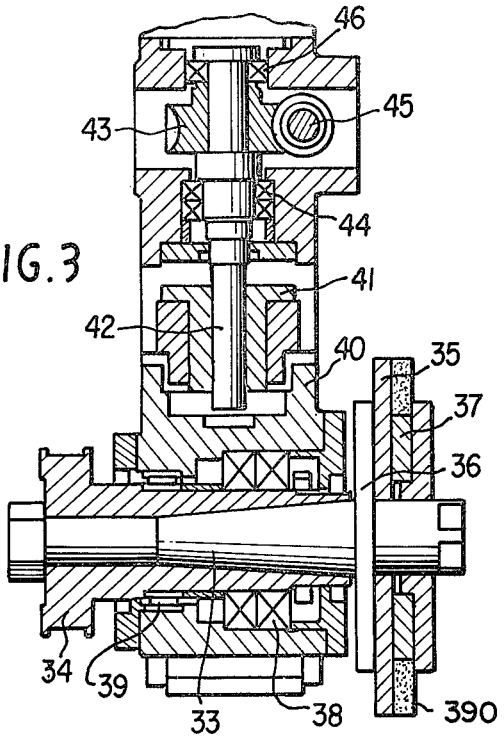
FIG. 3 is a sectional view taken along the line A—A of FIG. 2.
Figure 4:
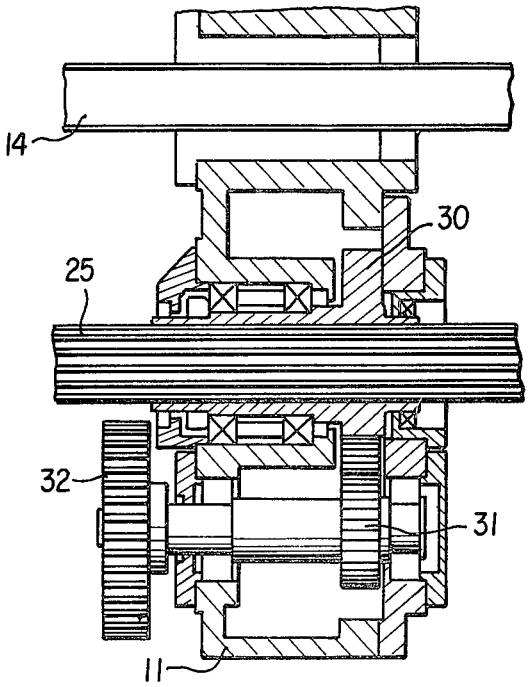
FIG. 4 is a sectional view taken along the line B—B of FIG 2.

A mechanism is provided that transmits rotation of the external power source 5 via a coupling 6 to cutter shafts by spline shafts 25 and 26 which pass through each head (see FIG. 1). The mechanism for transmitting rotation by the spline shaft 25 to the cutter shaft of each head is constructed as follows. The rotation of the motor is conveyed from a gear shaft 30, meshing with the spline shaft 25, to a gear shaft 31 (see FIG. 4). Then, from a timing pulley 32 fitted to one end of said gear shaft 31, the rotation is conveyed through a timing belt 53 to a timing pulley 34 press fit to a cutter shaft 33 which is journalled in a case 40 by high precision bearings 38 and 39 (see FIG. 3). A cutter 35 is screwed to a flange 36 provided on the cutter shaft 33, together with a ring 37 which is surrounded by a rubber ring 390, for processing a plate. Both ends of the case 40 which journals the cutter shaft 33, are choke shaped so that the case is vertically slidable in the cutter head. Nut 41 for a ball screw 42 is fixed to the case, which is vertically slidable by the rotation of the ball screw 42. The ball screw 42 is rotated by motors 21 or 22 through gears 45 and 43.

The construction of one embodiment of the present invention is described above and the operation and effects will now be described.

To position the cutters, first, the cases which journal the cutter shafts in heads 11-1 through 11-5 respectively are lifted up by motor 21 from a pass line to predetermined upper positions, and the cases which journal the cutter shafts in heads 12-1 through 12-5 respectively are lowered down by motors 22 from the pass line to predetermined lower positions. These upper and lower positions are set as the 0 (zero) points for the center shafts. The heads 11-1, 11-2, 12-1 and 12-2 are then moved to predetermined left end positions in FIG. 1, and heads 11-4, 11-5, 12-4 and 12-5 are moved to right end positions in FIG. 1. These end positions are set as 0 (zero) points for the heads, respectively. After finishing the above-mentioned preparatory operation (to be called backing to 0-point), cutter positioning operation can be started.

According to given cutting factors such as cutting width, strip numbers, plate thickness, etc., the distances between cutters are determined and input pulses corresponding to required lateral movement are set. Determination of the required amount of displacement is made as follows: when the head 11-1 is displaced to the right from its 0-point by 10mm, the amount of displacement for the head 11-2 is determined to be X $+\alpha$mm farther to the right from that position, where X is the given as the cutting width and $\alpha$ is an adequate clearance for X. Input for displacement is given by a number of pulses.

With the head 12-1, pulses corresponding to the displacement of 10 $+\alpha$mm are input, and with the head 12-2, pulses corresponding to X $+\alpha$mm, farther to the right from that point, are input. Likewise, for heads 11-3 and 12-3, 11-4 and 12-4, 11-5 and 12-5 input pulses corresponding to required displacements are input. To give the required cutting depth according to plate thickness, the required number of pulses corresponding to the cutting depth are input for the motors for vertical displacement. After completing the setting of the pulses above mentioned, when a starting switch is turned on, each motor operates by the number of turns equivalent to the input pulses and each head and cutter shaft moves laterally or vertically to position the cutters at desired points.

Figure 5:
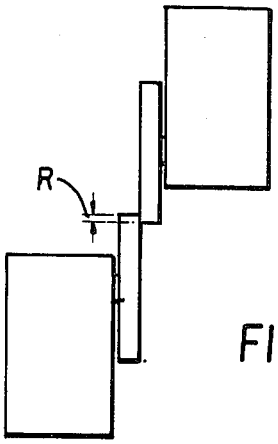
FIG. 5 is an enlarged front view of an upper and lower cutters showing their status of engagement.

The status of the engagement of the upper and lower cutters for slitting a plate is shown enlarged in FIG. 5. The lapping amount R of the upper and lower cutter edges are adjusted to suit the thickness of the plate to be slitted, whenever the plate thickness is changed.

When the engagement of the upper and lower cutter blades has been adjusted in accordance with the thickness of the plate to be slitted, the aforesaid readjustment of the location of the cutter set may also be simultaneously carried out to suit the slitting width by means of the following described method:

each cutter head is moved horizontally by a predetermined different speed. However, it is devised that the upper and lower cutting edges will not contact each other by moving a forward cutter faster than the rearward one, so that the cutter edges will not be contacted and damaged.

Figure 6:
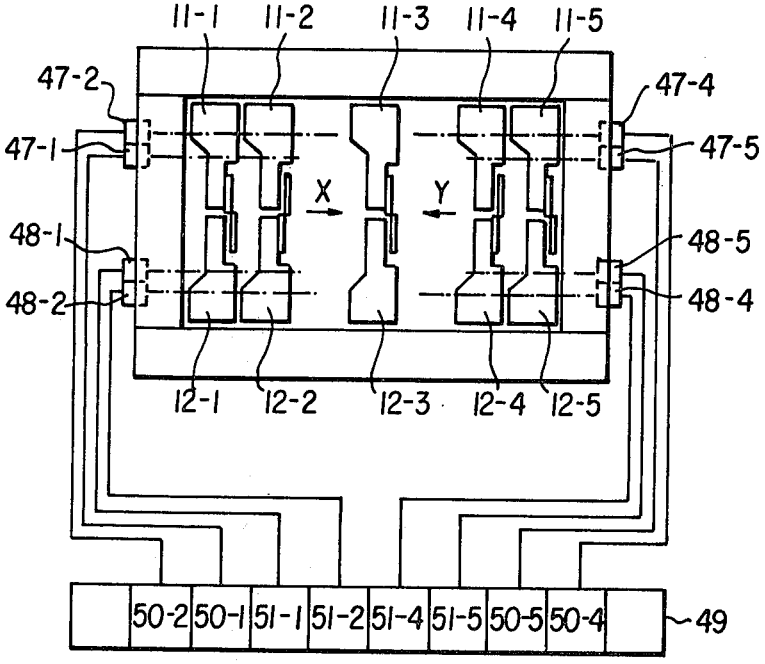
FIG. 6 is a block diagram of the circuit to set each speed of the respective cutter head.

The circuit diagram to set the speed of each respective cutter head is shown by a block diagram in FIG. 6. Respective upper cutter heads 11-1, 11-2, 11-4, 11-5 and respective lower cutter heads 12-1, 12-2, 12-4, 12-5, except fixed cutter heads 11-3, 12-3, are arranged to be moved horizontally back and forth by way of the direct current motors 47-1, 47-2, 47-4, 47-5 and 48-1, 48-2, 48-4, 48-5. Each of the motors is connected to the voltage setting instruments 50-1, 50-2, 50-4, 50-5 and 51-1, 51-2, 51-4, 51-5, each corresponding to a respective motor, and installed in a motor-voltage control box 49. The voltage to be applied to each motor is independently and differently controlled to set different moving velocities to the cutter heads.

Now, assuming that edges of upper and lower cutters of each head are set to engage as shown in FIG. 5; each cutter edge can be protected from bumping and damaging its mating edge even when they are moved simultaneously in X and Y directions by setting the velocity of the movement of each cutter head as follows:

Movement from the 0-point in the X direction, $$V_{11\text{-}2} > V_{12\text{-}2} > V_{12\text{-}1} > V_{11\text{-}1} \quad 1.$$

Movement from 0-point in the Y direction, $$V_{12\text{-}1} > V_{11\text{-}4} > V_{11\text{-}5} > V_{12\text{-}5} \quad 2.$$

The movement to the 0-point may be respectively carried out opposite to the above equations 1 and 2 and as follows:

$$V_{11\text{-}1} > V_{12\text{-}1} > V_{12\text{-}2} > V_{11\text{-}2} \quad 3.$$

$$V_{12\text{-}5} > V_{11\text{-}5} > V_{11\text{-}4} > V_{12\text{-}1} \quad 4.$$

In the actual operation for the changing of slitting width during operation, however, each head does not return to the 0-point of the left and right for each setting. Instead, width changing movements based on above equations 1, 2, 3 and 4 are started, the precise movement depending on whether the desired position to be set is in the 0-point side or X-side or Y-side in comparison to the initial position.

Although the slitter in this embodiment consists of five sets of heads, it is needless to mention that the same object can be accomplished by slitter stands consisted of three, four, six or seven sets. If a slitter stand of five sets of cutter heads is used for two strip cutting by three cuts, the cutter shafts of the proper set (or sets) determined by the plate width may be held above or below the pass line so that their cutters do not touch the plate while its being cut. Therefore, the slitter stand of five cutter head sets can perform slitting work of, including trimming, from two strip cutting by three cuts to four strip cutting by five cuts.

As above described, the present invention has made it possible to set cutters very easily simply by inputting pulses corresponding to given cutting factors such as cutting width, plate thickness, strip numbers, etc., instead of the conventional cutter resetting operation in which cutters and spacers are reassembled on cutter shafts or preparatory stands whenever cutting width or strip numbers are altered. The cutter reassembly work that required skilled hands and long delays has become possible to be finished within a matter of minutes by eliminating useless space and time which were needed for tool maintenance of a great number of cutters and spacers. Since this invention shortens cutter reassembly time that was about 30 minutes in the conventional method to only a few minutes, the slitter stand according to the present invention will serve greatly to increase productivity when the slitting time of one coil becomes shorter than the cutter reassembly time of the prior art. And it is possible, by interconnecting with an electric computer, to position cutters only by inputting factors such as cut numbers, cutting width, plate thickness, etc.

Since the present invention has, as described above, enabled automatic positioning of cutters in slitters on the slitter line. It is believed that the invention is useful for the first step toward full automatization of the conventional slitter line.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A gang slitter having automatically positioned cutters, said gang slitter comprising:

a frame assembly consisting of an upper frame having rails attached to the underside of said upper frame, a base having rails attached to the upperside of said base, and side frames;

fixed upper and lower cutter heads having cutter means and mounted on said upper frame and base, said cutter means adapted to operatively engage one another;

upper movable cutter heads including cutter means suspendedly and slidably mounted on said rails attached to upper frame;

lower movable cutter heads including cutter means and slidably mounted on said rails attached to said base, pairs of said upper and lower movable cutter means being adapted to be positioned adjacent one another to form a cutter pair;

cutter means journalling cases vertically slidably mounted on each said cutter head;

means for vertically driving all of said journal cases to adjust the vertical overlap of said cutter pairs;

spline shafts adapted for driving said cutter means from outside said cases being provided in said frame assembly and fixedly journalled by said side frames;

power transmitting means connected between said spline shafts and cutter means in said vertically slidable journalling cases, said power transmitting means being adapted to compensate for the vertical movement of said journalling cases relative to said spline shafts;

means for simultaneously, independently, horizontally moving all of said movable cutter heads for adjusting the width of the cut strips, said means for horizontally moving including means for moving the forwardly located cutter means of each said cutter pair, in the direction of movement, faster than the other cutter means of said pair whereby said cutter means are not damaged.

* * * * *